United States Patent [19]

Kurz

[11] Patent Number: 4,906,817

[45] Date of Patent: Mar. 6, 1990

[54] OVERFLOW COMPENSATION DEVICE FOR A WATER HEATER USING A VARIABLE VOLUME BELLOWS

[75] Inventor: Rolf Kurz, Bad Neustadt/Saale, Fed. Rep. of Germany

[73] Assignee: Forbach GmbH, Bad Neustadt/Saale, Fed. Rep. of Germany

[21] Appl. No.: 141,859

[22] Filed: Jan. 11, 1988

[30] Foreign Application Priority Data

Jan. 6, 1987 [DE] Fed. Rep. of Germany ..... 3700598

[51] Int. Cl.[4] ..... H05B 1/00; F24H 1/20; B65D 35/28

[52] U.S. Cl. ..... 219/310; 219/312; 219/314; 219/316; 219/323; 219/324; 222/95; 222/146.5; 137/341; 126/359; 126/383

[58] Field of Search ..... 219/310, 312, 314, 316, 219/324, 306, 323, 287; 126/362, 365, 359, 383; 222/146.1, 146.5, 109, 95, 571, 319, 108; 137/205.5, 206, 207, 207.5, 282, 341, 593

[56]. References Cited

U.S. PATENT DOCUMENTS

| | | | |
|---|---|---|---|
| 2,110,251 | 3/1938 | Wolcott | 219/287 |
| 2,598,968 | 6/1952 | Boosey | 137/282 |
| 2,819,376 | 1/1958 | Karlen | 219/316 |
| 2,869,760 | 1/1959 | Karlen | 222/319 |
| 2,870,318 | 1/1959 | Karlen | 219/312 |
| 2,894,109 | 7/1959 | Kendon | 219/312 |
| 3,080,119 | 3/1963 | Shutkufski | 137/207 |
| 3,202,321 | 8/1965 | Homeyer | 222/108 |
| 3,381,110 | 4/1968 | Fischer | 219/312 |
| 3,581,057 | 5/1971 | Meyers | 219/314 |
| 3,891,124 | 6/1975 | Dreibelbis | 219/312 |
| 3,905,518 | 9/1975 | Driebelbis | 219/312 |
| 4,263,498 | 4/1981 | Meyers | 219/312 |
| 4,391,459 | 7/1983 | Wicke | 219/312 |
| 4,424,767 | 1/1984 | Wicke | 219/306 |

FOREIGN PATENT DOCUMENTS

| | | |
|---|---|---|
| 516796 | 1/1931 | Fed. Rep. of Germany . |
| 610249 | 2/1935 | Fed. Rep. of Germany . |
| 1245084 | 7/1967 | Fed. Rep. of Germany . |
| 1404210 | 10/1968 | Fed. Rep. of Germany . |
| 2658720 | 11/1978 | Fed. Rep. of Germany . |
| 2828902 | 1/1980 | Fed. Rep. of Germany . |
| 3040450 | 5/1982 | Fed. Rep. of Germany . |
| 349834 | 6/1931 | United Kingdom . |
| 662739 | 12/1951 | United Kingdom . |
| 719140 | 11/1954 | United Kingdom . |
| 790950 | 2/1958 | United Kingdom . |
| 969953 | 9/1964 | United Kingdom . |
| 972091 | 11/1964 | United Kingdom . |
| 987785 | 3/1965 | United Kingdom . |
| 1332171 | 10/1973 | United Kingdom . |
| 1437386 | 5/1976 | United Kingdom . |
| 1459259 | 12/1976 | United Kingdom . |

*Primary Examiner*—Bruce A. Reynolds
*Assistant Examiner*—Scott A. Rogers
*Attorney, Agent, or Firm*—Spencer & Frank

[57] ABSTRACT

A volume compensation device for a hot water heater composed of a water tank equipped with a cold water inlet and a hot water outlet, for heating and storing water, the device including: a bellows enclosing a variable volume chamber; a conduit connected for placing the chamber in flow communication with the interior of the tank; and a pressure or temperature controlled lifting mechanism coupled to the bellows for varying the volume of the chamber in response to a temperature related change in the volume of the water in the tank.

17 Claims, 3 Drawing Sheets

OVERFLOW COMPENSATION DEVICE FOR A WATER HEATER USING A VARIABLE VOLUME BELLOWS

BACKGROUND OF THE INVENTION

The present invention relates to a volume compensation device for hot water heater including a water tank equipped with a cold water inlet and a hot water outlet, in which tank the water to be heated can be heated and stored.

Low pressure or open hot water heaters, as for example hot water storage devices, are constantly in communication with the atmosphere by way of an overflow pipe. The overflow pipe must never be closed because it must always be possible for water which expands when the contents of the water tank are heated to escape through the overflow pipe. The quantity of discharged overflow or expansion water is a function of the increase in temperature and the volume in the water tank. In most cases, the expansion water is discharged through the overflow pipe or through the tap or discharge faucet of a mixing arrangement suitable for low pressure devices.

This drop-by-drop discharge of expansion water results in calcium deposits at the discharge opening of the consumer tap and at the opening of the overflow pipe. On the one hand, such continuous dripping may annoy the consumer while, on the other hand, such calcium deposits also produce unsightly crust formations at the chrome-plated discharge pipes of the mixing device. Moreover, such deposits also reduce the discharge cross section of the overflow pipe. This may produce dangerous dynamic pressures. Regular and complicated decalcification with acid containing media is thus unavoidable.

German Pat. No. 3,040,450 discloses a hot water heater equipped with a volume compensation device for its water tank in which water can be heated and stored in a tank equipped with a cold water inlet and a hot water outlet. The water tank has an associated temperature responsive regulator with which the volume of the water tank can be changed according to the temperature-specific expansion of the volume of the stored water. This regulator is configured either as a temperature responsive, curvable, bimetal expandable bottom inserted into a wall region of the water tank, or the regulator is an expansion zone provided in an annularly circumferential wall region of the water tank, with the expansion of this zone in a direction axial to the plane of the ring being variable as a function of temperature. Alternatively, the regulator is variable in length as a function of temperature and is clamped in between two mutually facing, elastically deflectable membrane walls of the water tank. Moreover, the regulator may be variable in length as a function of temperature and may be supported at one end at a wall of the vessel and at its other end at a compressible membrane chamber disposed at the opposite wall of the water tank. According to another possibility, the regulator is variable in length as a function of temperature and is clamped in between two oppositely disposed walls of the water tank, with the water tank being provided with an annularly circumferential wall region around its longitudinal axis which is elastically expandable in the direction of the longitudinal axis. The regulator is then either a bimetal expansion rod, a bimetal strip or a hydraulic regulator which includes a cylinder equipped with a chamber containing a liquid which expands when heated and charges a membrane or a piston.

To equip such water tanks with curvable bimetal expansion bottoms or with membrane-like side walls in mass production requires enormously large expenditures for tools. Moreover, the introduction of a curved bimetal strip between two oppositely disposed elastically expandable walls of the water tank is handled, with respect to manufacturing technology, only with great difficulty and involves high installation costs. Since the water tank is subjected to constant mechanical changes in movement, only costly bronze sheet metal can be used as the wall material in such cases. If the otherwise customary thin copper sheets were used as the material for the tank, the water tank would tear open at the points of expansion after a relatively short period of operation because of these alternating mechanical stresses and would thus no longer be tight. The use of inexpensive plastic tanks, which must have relatively thick walls, is also impossible because of their relative rigidity.

SUMMARY OF THE INVENTION

It is an object of the present invention to provide, by simple means, a reliably operating volume compensation device for a hot water heater which can be manufactured and installed at low cost and operates extremely reliably.

The above and other objects are accomplished, according to the present invention, by a volume compensation device for a hot water heater composed of a water tank equipped with a cold water inlet and a hot water outlet, for heating and storing water, which device includes: a bellows enclosing a variable volume chamber; conduit means connected for placing the chamber in flow communication with the interior of the tank; and pressure or temperature controlled lifting means coupled to the bellows for varying the volume of the chamber in response to a temperature related change in the volume of the water in the tank.

Advantageous further features of the invention are described below.

The advantages to be realized with the present invention are, in particular, that, instead of a change in the volume of the entire water tank, only a small part thereof, in the form of a membrane-like bellows, accommodates the maximum developing quantity of expansion water during the heating process. Then, practically no alternating pressure stresses develop, a fact which ensures a long service life for the water tank. Another advantage is that the use of inexpensive plastic water tanks is also possible.

Several advantageous embodiments of the invention are illustrated in the drawing figures and will be described in greater detail below with reference thereto.

DESCRIPTION OF THE PREFERRED EMBODIMENTS

Figure 1:
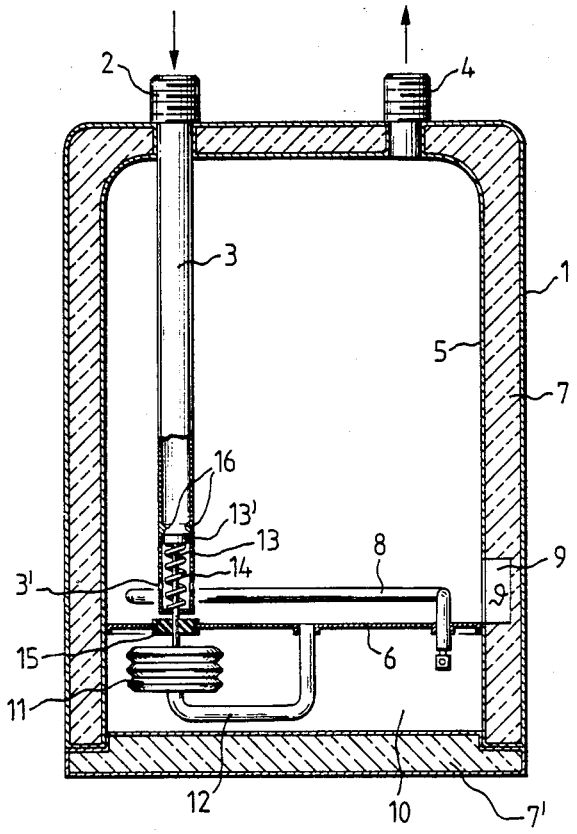
FIG. 1 is a longitudinal cross-sectional view of a low pressure hot water storage vessel for under-the-counter operation including a device disposed in the water inlet pipe for increasing the volume of the water tank according to an embodiment of the invention.
Figure 2:
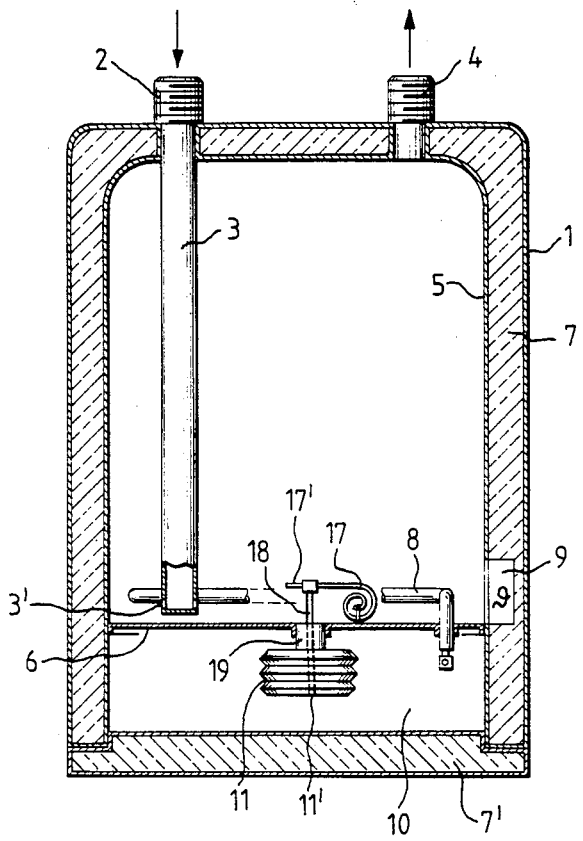
FIG. 2 is a longitudinal cross-sectional view of a low pressure hot water storage vessel for under-the counter operation including a bimetal device disposed in the middle of the bottom of the water tank for enlarging the volume of the water tank according to a further embodiment of the invention.
Figure 3:
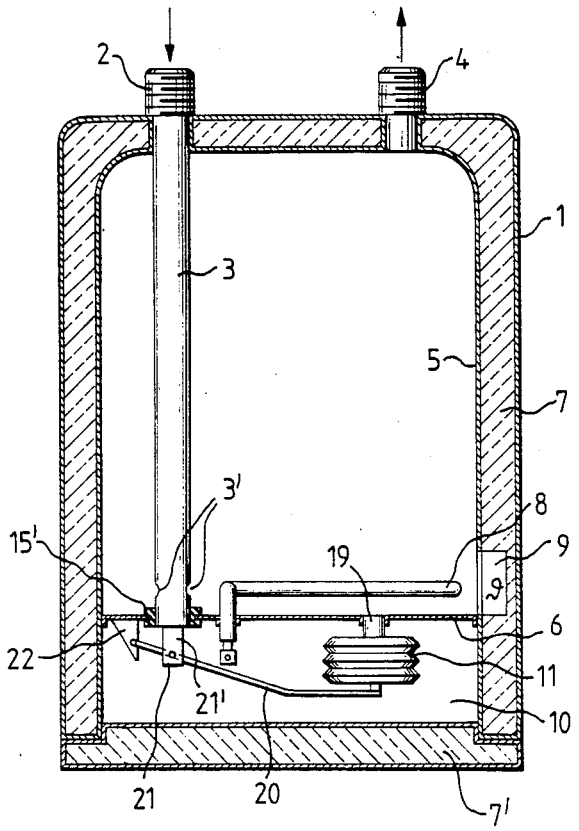
FIG. 3 is a longitudinal cross-sectional view of a low pressure hot water storage vessel for under-the-counter operation including a device disposed at the lower end of its water inlet pipe for enlarging the volume of the water tank according to a further embodiment of the invention.

The low pressure hot water heater shown in FIGS. 1–3 is designed as a hot water storage vessel for under-the-counter operation. This vessel includes an outer jacket 1 a cold water connection pipe or conduct 2 with inlet pipe or conduit 3 and inlet openings 3', a hot water connecting pipe or conduit 4 and a water tank or water storage container 5 having a bottom 6. The water tank 5 is enclosed on all sides and the bottom by thermal insulation 7, 7'. At the bottom 6 of water tank 5 there is fastened a heating means or rod 8 in a manner not shown in detail. A temperature regulating element 9 keeps the contents of water tank 5 constantly at a preselected temperature.

Below the bottom 6 of water tank 5 there is a flanged area 10 for accommodating conventional electrical connection members (not shown) and member having controllable interior volume or a variable volume bellows 11.

FIG. 1 now shows an embodiment in which one end of a curved pipe or conduit 12 is fastened at the bottom or bottom wall 6 of water tank 5 while the other end of pipe 12 is introduced from the bottom into bellows 11 so that pipe 12 places the interior of tank 5 in communication with the interior of bellow 11. In this embodiment, bellows 11 is precisely centered below inlet pipe 3 ending in the bottom region of water tank 5 and is in communication with the contents of water tank 5.

A plunger 13 with a piston 13' and a compression spring 14 are fastened to the upper side of bellows 11 and extend through a water-tight passage 15 into the lower end of inlet pipe 3 so that plunger 13 and piston 13' are axially movable in pipe 3. To limit the upward stroke of plunger 13, the interior of inlet pipe 3 is shaped to present delimiting nubs 16. The plunger 13, piston 13', spring 14, and nubs 16 together are referred to as an automatic means for controlling the interior volume of the bellows 11. This automatic means, the bellows 11, and the connecting conduit 12 together are referred to as an overflow preventing means.

Upon initiation of a water withdrawal process, the dynamic pressure existing in inlet pipe 3 is utilized to move piston 13' and its plunger 13 downwardly. This causes bellows 11 to be compressed and thus its volume to be reduced. The contents of bellows 11 are forced through curved pipe 12 into water tank 5 before cold water flows into tank 5.

Only when piston 13' is in its lower position will it open inlet openings 3' in inlet pipe 3 so that fresh water is able to flow into water tank 5. At the end of the water withdrawal process, plunger 13 is brought back into the illustrated rest, and closing, position by means of its compression spring 14. This simultaneously permits bellows 11 to expand. This expansion process is additionally supported by the static water pressure in tank 5. During this process, bellows 11 removes from water tank 5 the quantity of water which is reproduced by expansion when the contents of tank 5 are heated. That is, the water level existing in tank 5 is reduced by the amount which will be restored when the contents of tank 5 are heated, without expansion water now flowing out above hot water connection pipe 4. For this purpose, bellows 11 is dimensioned to have an available volume such that, in its expanded state, bellows 11 is able to hold at least four percent of the contents of tank 5.

In the embodiment shown in FIG. 2, a spirally wound bimetal strip 17 anchored firmly at the bottom 6 of tank 5 expands and compresses bellows 11 by way of a pull rod 18 fastened to the free end 17' of strip 17 and to the bottom 11' of bellows 11 so as to enlarge and reduce the volume of the bellows (these items together being referred to as an automatic means for controlling the interior volume of the bellows 11). The interior of bellows 11 is again in communication with the interior of tank 5 by way of a short pipe 19. Bellows 11, short pipe 19, pull rod 18, bimetal strip 17 (which together are referred to as an overflow preventing means) and heating rod 8 form a unit that can be introduced into tank 5 from the bottom in a manner which permits easy installation and replacement and is flanged to the bottom 6 of tank.

When the water in the lower part of the tank 5 is in a cold state, generally at the end of a water-withdrawal process, bimetal strip 17 is deflected upwardly and bellows 11 has its smallest volume. During the subsequent heating process for the contents of tank 5, bimetal strip 17 is deflected more and more downwardly and thus continuously increases the volume of bellows. In this way, the water level in tank 5 is prevented from rising and so is the escape of expansion water. To optimize the deflection of bimetal strip 17 during the heating process, the strip is provided with a heat return means via heat bridges or the like from heating rod 8.

FIG. 3 shows an embodiment in which inlet pipe 3 is a variable length rapid response member which expands and compresses bellows 11 by way of a lever mechanism 20. For this purpose, inlet pipe 3 is extended downwardly through a water-tight passage 15' in the bottom 6 of tank 5 and is provided with an extension 21'. Lever mechanism 20 is pivoted at the lower end 21 of this extension 21' and at a bearing block 22 fixed to tank bottom 6. During each water-withdrawal process, inlet pipe 3 is cooled by the inflowing water and contracts to pivot the lever mechanism 20, due to its attachment to extension 21', in a direction to reduce the volume of bellows 11. When the contents of tank 5 are heated, inlet pipe 3 expands again, which results, in turn, in expansion of bellows 11 and thus in an increase in its available volume. The lever mechanism 20, extension 21', inlet pipe 3, and bearing block 22 together are referred to as an automatic means for controlling the interior volume of the bellows 11. This automatic means, the bellows 11, and the conduit 19 together constitute an overflow preventing means. A thermocouple (not shown) between heating rod 8 and inlet pipe 3 supports this process.

The invention now being fully described, it will be apparent to one of ordinary skill in the art that many changes and modifications can be made thereto without departing from the spirit or scope of the invention as set forth herein.

What is claimed:

1. A water heater, comprising:

a water storage container having a bottom wall and a top wall;

heating means for heating water in said water storage container;

a cold water inlet conduit extending into said water storage container, said inlet conduit having at least one opening disposed near said bottom wall of said water storage container;

a warm water outlet conduit in fluid communication with said water storage container and having an opening near said top wall;

overflow preventing means for preventing the outflow of water from said water storage container via said warm water outlet conduit when cold water is being heated, said overflow preventing means including a connecting conduit having an open end connected adjacent said bottom wall in communication with said water storage container, a bellows having a controllable variable interior volume connected to and in communication with the other end of said connecting conduit, and automatic means for controlling said controllable variable interior volume of said bellows during expansion of the volume of the water in said water storage container due to heating to remove water from said water storage container; said automatic means for controlling said controllable variable interior volume of said bellows having an actuator portion which is coupled to said bellows and being responsive to a predetermined condition in said water storage container to cause expansion of said bellows to cause said bellows to remove water from said water storage container via said connecting conduit in an amount sufficient to prevent overflow of water from said water storage container through said outlet conduit.

2. A water heater as defined in claim 1 wherein said bellows, said connecting conduit, said automatic means, and said heating means are an installation unit which can be connected to flanges to said bottom wall of said water storage container.

3. A water heater as defined in claim 1 wherein said open end of said connecting conduit is disposed so as to be substantially flush with said bottom wall of said water storage container.

4. A water heater as defined in claim 1, wherein said connecting conduit is connected to said bellows at a bottom portion of said bellows.

5. A water heater as defined in claim 4, wherein said automatic means for controlling said controllable variable interior volume of said bellows comprises a plunger and a piston attached to said plunger which passes through said bottom wall of said water storage container, said plunger being axially guided in said inlet conduit, said plunger having an end which is connected to a side of said bellows which is opposite to the side of said bellows which is connected to said connecting conduit.

6. A water heater as defined in claim 5 wherein said automatic means further comprises a compression spring supported between said piston and an end of said inlet conduit.

7. A water heater as defined in claim 5 further comprising detent means in said inlet conduit for upwardly limiting the stroke of said plunger, said detent means comprising nubs.

8. A water heater as defined in claim 5 wherein said plunger is guided in a water-tight manner in a passage disposed in said bottom wall of said water storage container.

9. A water heater as defined in claim 1 wherein said bellows is disposed so as to be centered with respect to said inlet conduit and below said inlet conduit.

10. A water heater as defined in claim 9 wherein said bimetal element is a spirally curved bimetal strip.

11. A water heater as defined in claim 1 wherein said automatic means includes a bimetal element disposed in said water storage container and a pull rod coupled between said bellows and said bimetal element.

12. A water heater as defined in claim 11 wherein said heating means includes a heating element and said bimetal element is disposed in the vicinity of said heating element.

13. A water heater as defined in claim 11 wherein said bellows has a lower end; said pull rod being coupled to said lower end of said bellows; said automatic means for controlling the interior volume of said bellows including a lever arm coupled at one end to said bellows and at an intermediate portion to an extension portion of said inlet conduit which is disposed below said bottom wall of said water storage container, and the other end of said lever arm being pivotably connected to a bearing block.

14. A water heater as defined in claim 13 further comprising a thermocouple coupled between said heating element and said inlet conduit, and the capacity of said bellows in its expanded state is approximately four percent of the maximum volume of the contents of said water storage container.

15. A device as defined in claim 1 wherein said thermocouple is made of copper.

16. A device as defined in claim 1 wherein said thermocouple is in the form of sheet metal cups, bridges, or bands.

17. A device as defined in claim 11 wherein: the water tank has a bottom; said conduit means comprise a short pipe connecting said chamber to the bottom of the water tank; said device further comprises a thermocouple made of a material exhibiting good thermal conductivity coupled between the heating element and said bimetal element; and said bellows, said short pipe, said bimetal element and the heating element form an installation unit which is flanged to the bottom of the water tank.

* * * * *